US007692676B1

(12) United States Patent
Shirakawa et al.

(10) Patent No.: US 7,692,676 B1
(45) Date of Patent: Apr. 6, 2010

(54) THERMAL HEAD

(75) Inventors: Takashi Shirakawa, Iwate-ken (JP); Masakazu Kato, Iwate-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/139,307

(22) Filed: Aug. 24, 1998

Related U.S. Application Data

(63) Continuation-in-part of application No. 08/697,153, filed on Aug. 20, 1996, now abandoned.

(30) Foreign Application Priority Data

Aug. 30, 1995 (JP) ..... 7-222127
Feb. 8, 1996 (JP) ..... 8-22475

(51) Int. Cl.
*B41J 2/335* (2006.01)

(52) U.S. Cl. ..... 347/208

(58) Field of Classification Search ..... 347/200, 347/201, 202, 203, 208
See application file for complete search history.

(56) References Cited

U.S. PATENT DOCUMENTS 4,451,835 A * 5/1984 Saito ..... 347/208
4,617,575 A * 10/1986 Fuyama et al. ..... 347/208
5,477,266 A * 12/1995 Shirakawa ..... 347/208

* cited by examiner

*Primary Examiner*—Huan Tran
(74) *Attorney, Agent, or Firm*—Oblon, Spivak, McClelland, Maier & Neustadt, P.C.

(57) ABSTRACT

The present invention provides a thermal head capable of reliably preventing occurrence of connection failure or insulation failure in each of the layers in a multilayered wiring structure, enabling easy manufacture even in the real edging constitution, capable of maintaining reliability and, further, with no trouble in the terminal connection of a common electrode even if three or more thermal head. There is provided a thermal head comprising a thermal radiating substrate, a temperature keeping layer formed on the thermal radiating substrate, a conductive layer formed on the thermal radiating substrate and an upper surface of the temperature keeping layer comprised of a fused material of nitride and metal or a fused material of oxide and metal, a first interlayer insulation layer formed by oxidization of the conductive layer except a portion of the conductive layer corresponding to a common electrode and a portion of the common electrode corresponding to an external connecting common electrode terminal, a second interlayer insulation layer comprised of insulating ceramics formed on the upper surface of the first interlayer insulation layer, a heat generating resistor member formed above the second interlayer insulation layer and the conductive layer, a common electrode and individual electrodes formed at a part of the upper surface of the heat generating resistor member, and a protecting layer covering the heat generating resistor member, common electrode, individual electrodes and second interlayer insulation layer.

8 Claims, 6 Drawing Sheets

THERMAL HEAD

RELATED APPLICATIONS

The present application is continuation-in-part of Ser. No. 08/697,153 entitled "THERMAL HEAD AND MANUFACTURING METHOD THEREOF" and filed on Aug. 20, 1996 now abandoned. The disclosure of Ser. No. 08/697,153 is hereby expressly incorporated by reference.

BACKGROUND OF THE INVENTION

1. Field of the Invention

The present invention concerns a thermal head used for a thermal printer and it particularly relates to a thermal head capable of providing a thermal head with real edging and improvement for printing quality in a thermal transfer printer.

2. Description of the Related Art

A thermal head mounted on a thermal printer comprises a plurality of heat generating elements arranged linearly on a substrate in which electric current is supplied successively to the heat generating elements selectively based on desired printing information to heat the heat generating elements thereby conducting printing by forming color to heat sensitive recording paper in a heat sensitive printer or partially melting an ink of an ink ribbon and transferring the same to common paper in a thermal transfer printer.

FIG. 8 shows a general thermal head of the prior art in which a temperature keeping layer 2, for example, made of glass is formed on a heat dissipating substrate 1 made of an insulative material such as alumina (hereinafter referred to as a substrate), and the temperature keeping layer 2 is formed such that the upper surface forms an arcuate shape. A plurality of heat generating resistor members 3 are linearly arranged on the top 2*a* of the temperature keeping layer 2 linearly in a direction perpendicular to the drawing. The heat generating resistor member 3 is formed by depositing a material for the heat generating resistor member 3, for example made of Ta—$SiO_2$ on the surface of the temperature keeping layer 2 by means of sputtering or the like and then applying photolithographic etching. A common electrode 4*a* connected with each of the heat generating resistor members 3 is laminated at one side on the upper surface of the heat generating resistor member 3, while individual electrodes 4*b* for supplying eletric current to each of the heat generating resistor members 3 independently are laminated at the other side of each of the heat generating resistor members 3 on the upper surface of the heat generating resistor member 3 respectively. The common electrode 4*a* and the individual electrodes 4*b* are made, for example of Al and Cu and they are deposited by vapor deposition, sputtering or the like and then etched into a pattern of a desired shape.

Further, a protecting layer 5 of about 5 to 10 μm thickness is formed on the surface of the heat generating resistor members 3, the common electrode 4*a*, the individual electrodes 4*b*, and exposed surfaces of the substrate 1 and the temperature keeping layer 2, for protecting the heat generating resistor members 3 and each of the electrodes 4*a*, 4*b*. The protecting layer 5 is adapted to cover all the surface excepting for the terminal portion of each of the electrodes 4*a*, 4*b*.

In the existent thermal head as described above, since it is necessary to lower the resistance value of the common electrode 4*a* by making the width greater, and as shown in FIG. 8, a heat generating portion 3*a* of the heat generating resistor member 3 is disposed near a central or a peripheral portion of the substrate 1 of the thermal head and a size from the heat generating portion 3*a* of the heat generating resistor member 3 to the end of the substrate 1 is not less than 1 mm (hereinafter referred to as an edge distance L).

However, a demand for so-called real edging of disposing the heat generating resistor member 3 of the thermal head to the end of the substrate 1 has been increased more and more in recent years, which necessities to remarkably decrease a space on the side of the common electrode 4*a* of the substrate 1.

The real edging of the thermal head is advantageous in that a loss of contact pressure between the head and the platen can be reduced, efficiency for printing energy can be improved and inks in a wide range from wax type to resin type can be used in a case of a thermal transfer printer using an ink ribbon, thereby remarkably improving printing quality on rough paper.

However, if it is intended for real edging of decreasing the edge distance of the thermal head, for example, to less than 0.2 mm, since the space for disposing the common electrode 4*a* is decreased remarkably, the lateral size of the common electrode 4*a* has to be made extremely small and, as a result, the common electrode 4*a* functions like that a resistor member to increase the resistance value thereby increasing the difference of voltage drop between both ends and the central portion of the heat generating resistor member 3. Further, it results in lack of the current capacity for the common electrode 4*a* to bring about a trouble such as fusion of the common electrode 4*a* upon current supply to each of the heat generating resistor members 3 making it extremely difficult to manufacture a real edge head of high practical usefulness.

Further, in another type of electrode for a thermal head intended for real edging, the common electrode 4*a* is lead in the direction identical with individual electrodes 4*b*, for example, in the form a turn back type or a comb-type electrode although not illustrated. However, since the common electrode 4*a* and the individual electrodes 4*b* are led out in the identical direction, identical fabrication accuracy is required for a case of resolution power at 300 dpi with that for a case of resolution power at 600 dpi and in the same manner, a fine fabrication technique is required for the resolution power at 400 dpi like that for resolution power at 800 dpi, which increases the number of production steps, lowers yield and lowers the reliability, as well as increase in the manufacturing cost.

In other type of electrode, a common electrode 4*a* is formed from the end face to the rear face of a substrate 1 of a thermal head. However, since the electrode is formed after dividing and polishing the substrate 1, the number of manufacturing steps is increased to lower the manufacturing efficiency, as well as this brings about a drawback that the reliability for real edging of less than 0.2 mm distance is extremely low.

In a further example of an end face edge in which a temperature keeping layer 2 is formed by polishing the end face of a substrate 1 and a heat generating resistor member 3 is formed on the upper surface thereof, the number of manufacturing steps is increased in the same manner as described above and the mass productivity is poor in a case of intending for real edging and the manufacturing cost is expensive.

Then, in the prior art system, there has been provided a coupling-type thermal head as shown in FIG. 9. Although each of thermal heads 8,8 to be connected has the same layer as that of the aforesaid prior art, its major difference consists in the fact that a common electrode terminal 9 related to an external connection of the common electrode 4*a* is arranged only at one side of either the right side or the left side. That is, the prior art coupling type thermal head is constructed such that the two thermal heads 8,8 having lateral symmetry shape from each other are adhered to a coupling substrate 10.

A reason why the number of connecting thermal heads in the prior art is two consists in the fact that each of the common electrode terminals 9,9 shown in FIG. 9 is formed only at one of the right side or the left side of each of the thermal heads 8,8. That is, there was no practical means for connecting more than three common electrodes of the thermal head.

In view of the above, it has been attempted to attain real edging by making the common electrode 4*a* into a multilayered wiring structure in a heat generating portion. In this structure, a conductive layer 6 made of a metal is formed on the temperature keeping layer 2 an interlayer insulation layer, for example, made of $SiO_2$ is laminated thereon by means of sputtering or the like and then the interlayer insulation layer 7 is partially eliminated photolithographically, on which a heat generating resistor member 3 is stacked thereby electrically connecting the conductive layer 7 with the heat generating resistor member 3, that is, the interlayer insulation layer 7 and the conductive layer 6 are formed in a layerous structure just below the heat generating resistor member 3 that generates heat at a high temperature.

In the thermal head of the multilayered wiring structure as described above, when electric current is supplied to a desired heat generating resistor member 3 by way of an individual electrode 4*b* based on a desired printing signal, since electric current is supplied to the terminal portion by way of the conductive layer 6 in addition to the common electrode 4*a* formed at an extremely small lateral size by real edging, so that the resistance value of the common electrode 4*a* is not increased thereby enabling to prevent generation of a partial voltage difference in the heat generating resistor member 3, and lack of current capacity of the common electrode 4*a*, to attain high quality printing.

However, in the existent thermal head described above, since the interlayer insulation layer 7 is formed to the upper surface of the conductive layer 6 and each of the layers if formed just below the heat generating resistor member 3 that generates heat at high temperature, stresses between each of the layers is large and reliability for close bonding between each of the layers against thermal impacts is remarkably deteriorated. Further, since the interlayer insulation layer 7 is formed by etching, a step is caused to the surface of the interlayer insulation layer 7 and the conductive layer 6, and the step may possibly cause connection failure between the heat generating resistor member 3 and the conductive layer 6. Further, if the interlayer insulation layer 7 is formed by a vapor deposition method such as sputtering, pinholes are generated due to obstacles to the interlayer insulation layer 7 to bring about insulation failure for the interlayer insulation layer 7.

SUMMARY OF THE INVENTION

It is an object of the present invention to provide a thermal head capable of reliably preventing occurrence of connection failure or insulation failure in each of the layers in a multilayered wiring structure, enabling easy manufacture even in the real edging constitution, capable of maintaining reliability and, further, with no trouble in the terminal connection of a common electrode even if three or more thermal head. In order to accomplish the aforesaid object, the thermal head of the present invention has the following configuration. That is, there is provided a thermal head comprising a thermal radiating substrate, a temperature keeping layer formed on the thermal radiating substrate, a conductive layer formed on the thermal radiating substrate and an upper surface of the temperature keeping layer comprised of a fused material of nitride and metal or a fused material of oxide and metal, a first interlayer insulation layer formed by oxidization of the conductive layer except a portion of the conductive layer corresponding to a common electrode and a portion of the common electrode corresponding to an external connecting common electrode terminal, a second interlayer insulation layer comprised of insulating ceramics formed on the upper surface of the first interlayer insulation layer, a heat generating resistor member formed above the second interlayer insulation layer and the conductive layer, a common electrode and individual electrodes formed at a part of the upper surface of the heat generating resistor member, and a protecting layer covering the heat generating resistor member, common electrode, individual electrodes and second interlayer insulation layer.

Further, as a preferable configuration of the present invention, the second interlayer insulation layer is formed by insulating ceramics comprised of at least one of silicon nitride, silicon oxide, aluminum nitride or aluminum oxide. In addition, this invention relates to a thermal head, wherein more than three common electrode terminals of the common electrode for the external connection are formed in the thermal radiating substrate.

Then, employing such a configuration as above enabled a degree of reliability in insulating characteristic at the interlayer insulation layer to be remarkably improved. In addition, the common electrode terminal could be arranged not only at both right and left sides of the thermal head, but also at a plurality of locations at the central section, so that an applying of voltage to each of the heat generating resistor members could be made uniform. Further, making a single layer of the common electrode enabled a mechanical strength of this portion to be increased and such a structure as one in which no peeling-off of the film is generated against a press contacting pressure during printing operation has been realized.

In addition, as another preferable configuration, cutting planes of the temperature keeping layer, conductive layer, first interlayer insulation layer, second interlayer insulation layer and protecting layer at the cutting plane of the thermal head cut in a direction perpendicular to arranging directions of a plurality of the heat generating resistor members in the aforesaid configuration are formed substantially in perpendicular to a plane of the thermal radiating substrate and the cutting plane at the thermal radiating substrate is substantially in flush with the cutting plane at the film layer portion. Or, the cutting plane of the thermal radiating substrate forms a slant plane entered into the thermal radiating substrate.

Then, employing such a configuration as above enables an accuracy of connection of the connected thermal head to be increased and then manufacturing quality of the coupling type thermal head to be also improved.

In order to accomplish the aforesaid object, another thermal head of the present invention has the following configuration. That is, there is provided a thermal head comprising a thermal radiating substrate, a temperature keeping layer formed on the thermal radiating substrate, a conductive layer formed on the thermal radiating substrate, wherein one of silicon nitride, silicon oxide, aluminum nitride or aluminum oxide or these complex materials being applied as insulation material, and the conductive layer being formed by conductive thermet comprised of fused material of this insulation material and metal of high melting point, a first interlayer insulation layer formed by oxidization of the surface of the conductive layer except a portion of the conductive layer corresponding to a common electrode and a portion of the common electrode corresponding to an external connecting common electrode terminal, a second interlayer insulation layer comprised of insulating ceramics formed on the upper surface of the first interlayer insulation layer, a heat generating resistor member formed above the second interlayer insulation layer and the conductive layer, a common electrode and individual electrodes formed at a part of the upper surface of the heat generating resistor member, and a protecting layer covering the heat generating resistor member, common electrode, individual electrodes and second interlayer insulation layer.

Further as a preferable configuration, the metal of high melting point is tantalum. Then, employing such a configuration as above enables the thermal radiating substrate and the temperature keeping layer to have a superior close fitness even if oxidation processing is carried out at a high temperature.

In order to accomplish the aforesaid object, a still further thermal head of the present invention has the following configuration. That is, there is provided a thermal head comprising a thermal radiating substrate, a temperature keeping layer formed on the thermal radiating substrate, a conductive layer formed on the thermal radiating substrate, wherein the conductive layer being formed of conductive ceramics comprised of boride, nitride, carbide or silicide of high melting point metal, a first interlayer insulation, layer formed by oxidization of the surface of the conductive layer except a portion of the conductive layer corresponding to a common electrode and a portion of the common electrode corresponding to an external connecting common electrode terminal, a second interlayer insulation layer comprised of insulating ceramics formed on the upper surface of the first interlayer insulation layer, a heat generating resistor member formed above the second interlayer insulation layer and the conductive layer, a common electrode and individual electrodes formed at a part of the upper surface of the heat generating resistor member, and a protecting layer covering the heat generating resistor member, common electrode, individual electrodes and second interlayer insulation layer.

Then, employing such a configuration as above enables the conductive layer to have a superior close fitness between the thermal radiating substrate and the temperature keeping layer even if oxidation processing is carried out at a high temperature.

DETAILED DESCRIPTION OF PREFERRED EMBODIMENTS

Figure 1:
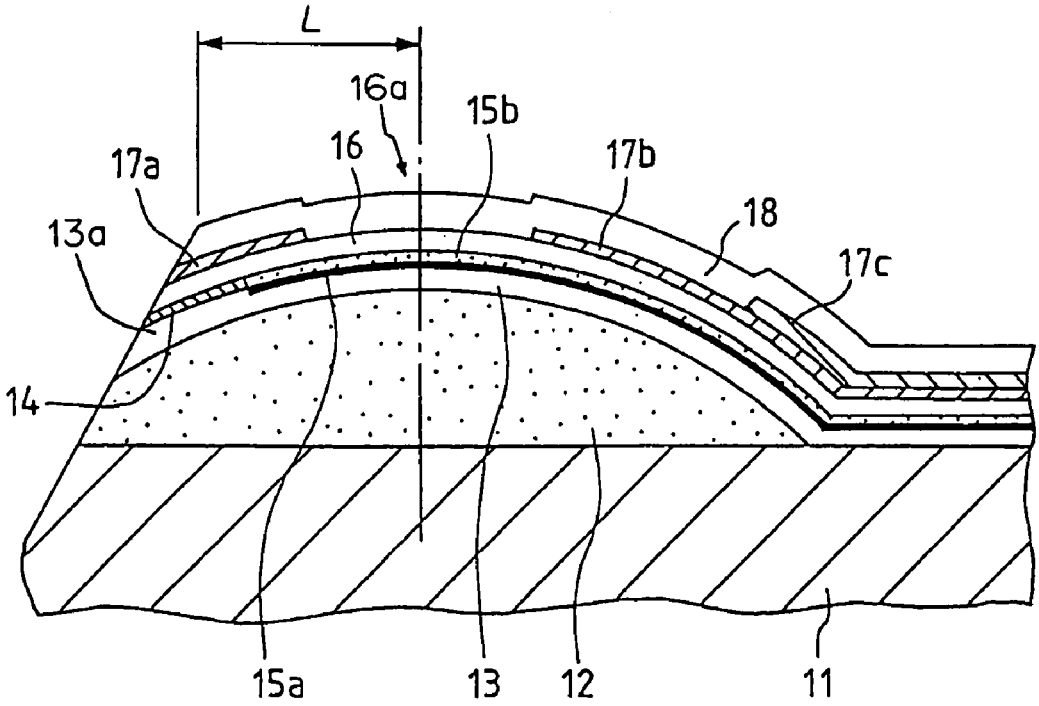
FIG. 1 is a cross sectional view of a thermal head in a first embodiment according to the present invention.
Figure 2:
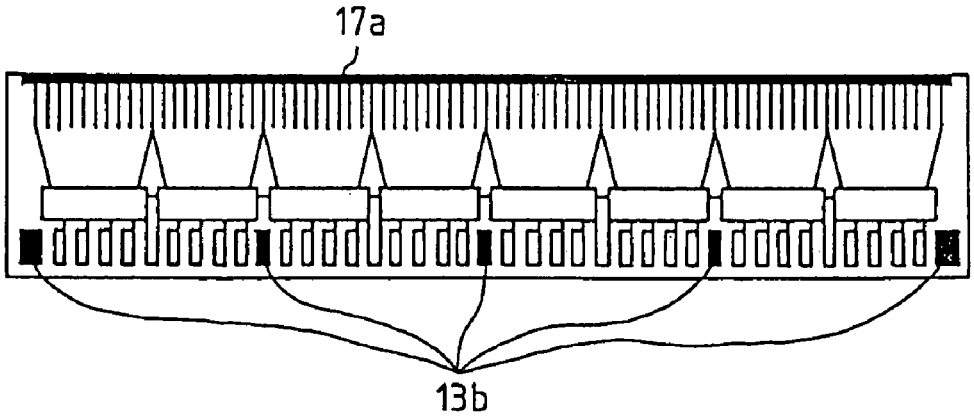
FIG. 2 is a plan view of a thermal head in the first embodiment according to the present invention.
Figure 3:
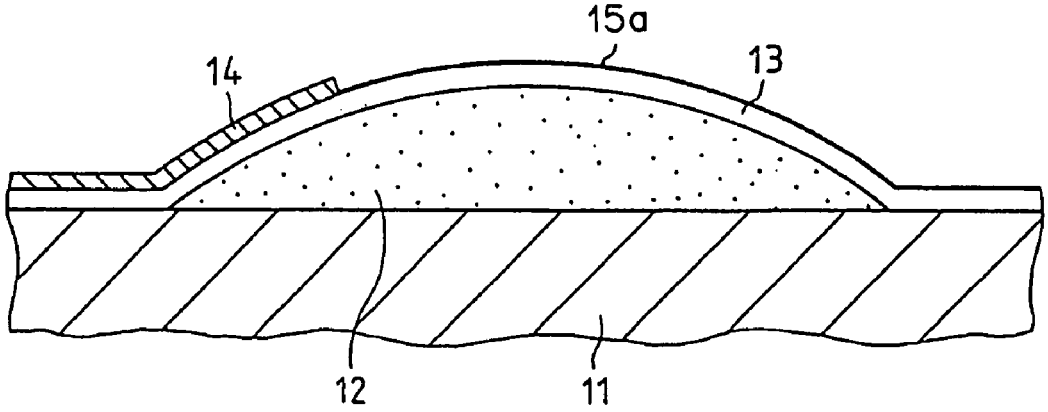
FIG. 3 is a cross sectional view illustrating a multilayered wiring substrate in the course of manufacturing the first embodiment according to the present invention.

The present invention is explained by way of preferred embodiments thereof with reference to FIG. 1 to FIG. 3.

A thermal head shown in FIG. 1 comprises a temperature keeping layer 12, for example, made of glass having an arcuate sectional surface on an insulative substrate 11, for example, made of ceramics. A conductive layer 13 made of fused material comprised of metallic nitride and metal and also having both a low heat conducting and a low thermal expansion is formed by sputter deposition or the like to a film of about 3 to 10 μm thickness on the upper surface of the substrate 11 and the temperature keeping layer 12. As the fused material of the metal nitride and the metal, a fused material of aluminum nitride and tantalum is preferred, but a fused material of a metal oxide and a metal can also be used instead of the fused material of the metal nitride and the metal; in which a fused material of aluminum oxide and tantalum is suitable. A target material used for forming the film of the conductive layer 13 by sputtering is a sintered material of aluminum nitride and tantalum in the case of the former and a sintered material of aluminum oxide and tantalum in the case of the latter. A compositional ratio with 50 to 70% of tantalum is preferred in each of the cases for satisfying functions described latter, and a sintered target comprising a composition of 60% tantalum and 40% aluminum nitride is used in this embodiment. The conductive layer 13 can be replaced with a conductive ceramic comprising a boride, nitride or silicide of a high melting metal.

At the conductive layer 13, the portion of the exposed part 13*a* positioned at the arranging part of the common electrode 17*a* and the common electrode terminal 13*b* for the external connection (see FIG. 2) are covered by the mask layer 14 having an anti-acid characteristic as shown in FIG. 3, the surface of the conductive layer 13 is thermally oxidized, thereby the first interlayer insulation layer 15*a* is formed to have a thickness of about 1 to 2 μm. That is, since the first interlayer insulation layer 15*a* is not formed at the exposed part 13*a* and the common electrode terminal 13*b*, an electrical conduction with the conductive layer 13 at these portions can be attained.

The oxidation resistant mask layer 14 used for forming the first interlayer insulation layer 15*a* comprises insulative silicon dioxide or conductive molybdenum silicide. The mask layer is formed to a thickness of about 0.3 μm by sputter deposition or the like in continguous with the conductive layer 13 and then removed photolithographically by etching with buffered hydrofluoric acid (BHF) in a case of using silicon dioxide to form a pattern of oxidation resistant mask layer 14. On the other hand, in a case of using molybdenum silicide, the pattern of oxidation resistant mask layer 14 is formed by dry etching with $CF_4$+$0_2$ gas and then thermal oxidization is applied. In this case, even after occurrence of thermal oxidation since the molybdenum silicide is conductive, elimination of the mask layer 14 is optional. In FIG. 1 is illustrated a case in which this oxidization resistant mask layer 14 is left. The material is selected such that aluminum nitride and alumina give a protecting effect as an etching resistant material for the conductive layer 13 against the etchant.

On the other hand, in the case that the oxidation resistant mask layer 14 is formed by silicon dioxide, the conductive layer 13 is not electrically conductive with the heat generating resistor member 16 at the upper layer unless the oxidation resistant mask layer 14 is removed after thermal oxidation and the exposed part 13*a* of the conductive layer 13 is arranged.

The oxidizing treatment for forming a first interlayer insulation layer 15*a* in this embodiment is conducted as a heat treatment at a temperature of 700° C. for 3 to 9 hours in a surrounding atmosphere in view of a heat resistant limit of the temperature keeping layer 12 made of glass or the like. The thermal oxidization for the conductive layer 13 may be replaced with plasma oxidation.

Further, a second interlayer insulation layer 15*b* made of an oxide, nitride (insulation ceramic) of silicon or aluminum is formed to a thickness of about 0.1 to 1.0 μm by sputtering or the like on the upper surface of the first interlayer insulation layer 15*a* on the conductive layer 13, which is then photolithographically etched to expose the conductive mask layer 14 and form composite interlayer insulation layers 15*a*, 15*b*. In this case, when the insulating mask layer 14 is formed, the mask layer 14 is eliminated entirely in the same manner as in the first embodiment.

Further, a heat generating resistor member 16 made, for example, of Ta—$SiO_2$ is formed from above by sputtering or the like and then photolithographically etched to form a plurality of heat generating resistor members 16. Each of the heat generating resistor members 16 is formed such that the both ends thereof situate on the conductive mask layer 14 and the second interlayer insulation layer 15*b* respectively.

In addition, above the oxidation resistant mask layer 14 placed at one side of the heat generating section 16*a* is laminated the common electrode 17*a* through the heat generating resistor member 16. Further, above the heat generating resistor members 16 at the other side of the heat generating section 16*a* is formed a first individual electrode 17*b* for performing an independent electrical energization for each of the heat generating resistor members 16. This common electrode 17*a* and the first individual electrode 17*b* are formed by a thin film of metal of high melting point or its silicide. In addition, the second individual electrode 17*c* made of aluminum, copper or gold is formed at a position spaced apart from the heat generating part 16*a* above the first individual electrode 17*b*. In this case, it is not necessary that soft electrical conductive material such as the second individual electrode 17*c* is arranged at the common electrode 17*a* side due to a multilayer wiring formation, and its electrode can be made to have hard and thin characteristic, resulting in that a mechanical strength at this portion can be improved. Due to this fact, even if the real edge formation is promoted more, there occurs no disadvantage that the protection layer is peeled off against the press contacting force applied to the part during printing, and further, a reduction of printing endurable life of the thermal head can be prevented.

In a second embodiment shown in FIG. 4, the heat generating resistor members 16 and each of the electrodes 17*a*, 17*b* are formed in the order opposite to the above, in which a common electrode 17*a* and the first individual electrodes 17*b* are formed by stacking a high melting metal or a silicide of a high melting metal to a thickness of about 0.1 to 0.5 μm by sputtering or the like below the heat generating resistor member 16 and then photolithographically etching the same. The material for the heat generating resistor member is stacked to the upper surface in the same manner and etched to form a heat generating resistor member 16. Only the individual electrode 17*c* is formed on the upper surface by stacking a conductive material made of aluminum, cooper, gold or the like by sputtering and then photolithographically etching the material. As described above, since the soft electrode material is not used, the common electrode 17*a* is made of a high melting metal or a silicide thereof and formed thinly only below the heat generating resistor member 16, working life can be improved for printing load concentrated on the common electrode 17*a* of the read edge thermal head.

A method of manufacturing a read edge thermal head in the first and second embodiments is to be explained with reference to a flow chart illustrating the steps of manufacturing a multilayered wiring substrate shown in FIG. 5.

Figure 5:
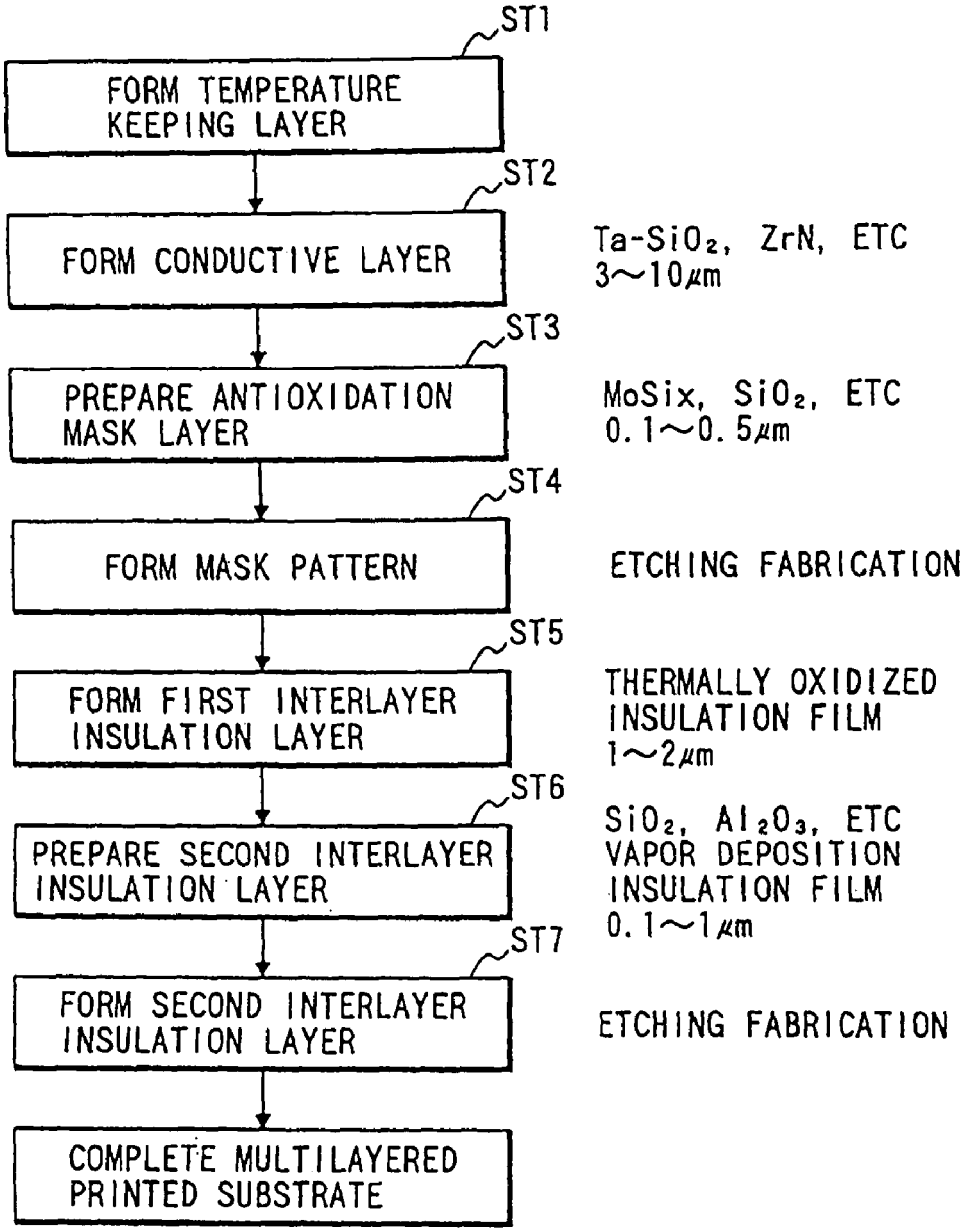
FIG. 5 is a flow chart illustrating a method of manufacturing a multilayered wiring substrate of a thermal head of a first and a second embodiment.

Referring to FIG. 5, a temperature keeping layer 12, for example, made of glass having an arcuate upper surface is formed being protruded on the upper surface of a flat substrate 11 made, for example, of aluminum (step ST1).

Then, a thermet comprising a high melting metal Ta, Cr, Mo, W, Ti, Zr, Nb, Hf or V and an insulation material $Si0_2$, $Si_3N_4$, $A1_20_3$ or A1N, or a conductive ceramic comprising a boride, nitride, carbide or silicide of a high melting metal is formed to a thin film of about 3 to 10 μm by sputtering or the like on the upper surface of the substrate 11 and the temperature keeping layer 12, to form a conductive layer 13 (step ST 2).

Then, a mask layer 14 of molybdenum silicide having heat resistance, oxidation resistance and conductivity or insulative $Si0_2$ is stacked to a thickness of about 0.1 to 0.5 μm by sputtering or the like to the upper surface of the conductive layer 13 (step ST3).

Then, a mask pattern of the oxidation resistant mask layer 14 is formed photolithographically at a position corresponding to the wiring part of the common electrode 17*a* and the arranging part of the common electrode terminal 13*b* (step ST4).

Then, the surface of the conductive layer 13 is compulsorily oxidized by heat treatment in an oxygen atmosphere (at about 700 to 800° C. for 2 to 9 hours) or plasma oxidation to form a first interlayer insulaiton layer 15*a* of about 1 to 2 μm thickness (step ST5).

Then, one of $Si0_2$, $Si_3N_4$, $A1_20_3$ or A1N having heat resistance, oxidation resistance and insulation property is stacked to a thickness of about 0.1 to 1.0 μm by sputtering or the like on the upper surface of the first interlayer insulation layer 15*a* and this is applied as a second interlayer insulation layer (step ST6).

Then, the aforesaid second interlayer insulation layer at a position corresponding to the wiring part of the common electrode 17*a* and the arranging part of the common electrode terminal 13*b* is removed by photolithographic etching, to expose the conduction portion of the mask layer 14, to thereby complete the manufacture for the multilayered wiring substrate in this embodiment (step ST7).

Subsequently, the heat generating resistor members 16, each of the electrodes 17*a*, 17*b*, 17*c* are formed on the multilayered wiring substrate, on which the protecting layer 18 is covered to manufacture a real edge thermal head as shown in FIG. 1.

Figure 4:
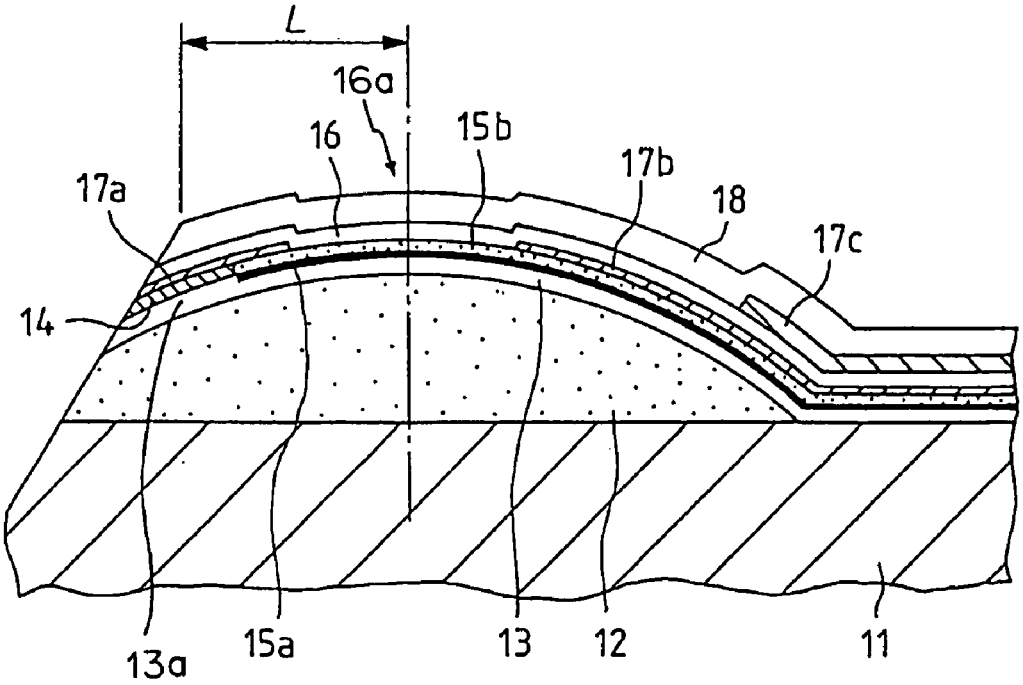
FIG. 4 is a sectional view for showing the thermal head in a second preferred embodiment of the present invention.

Alternatively, before forming the heat generating resistor member 16 on the multilayered wiring substrate, each of the electrodes 17*a*, 17*b* made of a high melting metal or a silicide thereof is formed to a thickness of about 0.1 to 0.05 μm, on which the heat generating resistor member 16 and the second electrodes 17*c* are formed and further the protecting layer 18 is covered further thereon, to manufacture a real edge thermal head as shown in FIG. 4.

The effect of the first and second embodiments is explained.

In these embodiments, when an electric current is supplied to a desired heat generating resistor member 16 by way of individual electrodes 17*b*, 17*c* based on a desired printing signal, since the conductive layer 13 having the same function as the common electrode 17*a* is disposed substantially over the entire surface of the substrate 11, the electric current flows through the conductive layer 13 in addition to the common electrode 17*a*, so that a uniform voltage can be applied to each of the heat generating resistor members 16 whereby an irregular concentration of printing can be eliminated.

Further, when a voltage is applied from both ends of a substrate 11 in a line thermal head having a remarkably large longitudinal/lateral ratio of the substrate, since a distance to the central portion of the substrate 11 is long, voltage drop occurs in the substrate 11 due to the increase of the resistance value of the common electrode 17*a*, which lowers the temperature of heat generated by the heat generating resistor member 16 to result in uneven printing density. On the contrary, in the thermal head of this embodiment, since the conductive layer 13 is laid over the entire surface of the substrate 11 of the thermal head, the common electrode terminal 13*b* for use in external connection of the common electrode 17*a* can be taken out at an optional position on the upper surface of the substrate 11 as shown in FIG. 2, so that three or more thermal heads can be connected without considering connection of the common electrode 17*a*. That is, in the line thermal head described above, the voltage can be applied not on both ends of the substrate 11 but also on the central portion of the substrate 11, so that a uniform voltage is applied to each of the heat generating resistor members 16 to eliminate occurrence of uneven printing density.

Then, in this embodiment, the fused film of the metal nitride and the metal used as the conductive layer 13 has advantages to having low heat conductivity and low heat expandability excellent close bondability with the substrate 11 and the temperature keeping layer 12, resistance to high temperature annealing, reduced heat conductivity compared with that of the metal film and did not deteriorate the thermal characteristics of the thermal head.

In this case, since the first interlayer insulation layer 15*a* comprising the insulative oxide formed by compulsorily oxidizing the surface of the conductive layer 13 is used for attaining the reliability of the insulation property of the conductive layer 13 in this embodiment, the heat generating resistor member 16 and each of the electrodes 17*a*, 17*b*, 17*c*, the inside of the pinholes of the second interlayer insulation layer 15*b* on the conductive layer 13 also has the insulating property. Further, since the layer 15*a* can be formed integrally the conductive layer 13, reliability for the insulation property and the close bondability can be improved. Further, since the second layer insulation layer 15*b* of excellent insulation property and close bondability comprising an oxide or a nitride of silicon or aluminum is stacked on the upper surface of the first interlayer insulation layer 15*a* to constitute close bondability of interlayer insulation layers, 15*a*, 15*b*, the reliability for the insulation property and the adhesion can be improved remarkably for the multilayered wiring substrate in this embodiment. Further, in this embodiment, since the first interlayer insulation layer 15*a* can be formed integrally by oxidizing the surface of the conductive layer 13 and since the mask layer 14 if it is made of the conductive layer can be used without removing the same, the surface of the first interlayer insulation layer 15*a* and the surface of the conductive mask layer 14 as the exposed portion of the conductive layer 13 can be made substantially in flush with each other. Further, since the heat generating resistor member 16 and the common electrode 17*a* can be formed with a small step on the second interlayer insulation layer 15*b* having a layer thickness within a range from about 0.1 to 1.0 μm, so that electrical connection can be made more reliably.

Further, since either a thermet of high melting point metal or a conductive ceramic is used for the conductive layer 13 in this embodiment, it is essentially excellent in heat resistance, heat insulation property and close bondability and does not lower the thermal efficiency of the heat generating member even when it is formed over the entire surface of the substrate 11. Further, since it is not necessary to dispose a soft conductor material for the common electrode 17*a*, a thermal head of excellent printing life can be obtained even if it is real edged extremely.

Accordingly, in the read edge thermal head of this embodiment, even if a space for the wired portion of the common electrode 17*a* is read edged extremely, since the conductive layer 13 having the same function as the common electrode 17*a* is disposed over substantially the entire surface of the substrate 11 and the composite interlayer insulation layers 15*a*, 15*b* are provided, a uniform voltage can be applied for each of the heat generating resistor members 16, unevenness in the printing density or troubles caused by lack of current capacity or current leak can be prevented reliably and a thermal head real-edged nearly to its limit can be manufactured at a good yield.

By the way, the edge distance in the real edge thermal head in this embodiment, that is, a distance from the center of the heat generating element disposed at the end of the substrate 11 to the edge of the substrate 11 peeling off the ink ribbon can be made easily to less than 100 μm either in a serial head or a line head. As a result, such a novel improving effect as not obtainable in the prior art can be obtained. Since real edge can thus be attained extremely, the size can be reduced for the substrate 11 and the manufacturing cost can be reduced. Further, a resinous ink ribbon not usable in the existent thermal head can be used to remarkably improve printing quality on rough paper.

Further, in the extremely real edged thermal head loss of contact pressure of the heat generating element to the platen is remarkably reduced, the effect of collapsing unevenness of paper fibers in increased to remarkably improve the printing quality on rough paper and transfer efficiency is improved to attain saving of electric power.

In the aforesaid thermal head, an individual thermal head is manufactured by a method wherein thermal head substrates of a plurality of thermal heads having the temperature keeping layer 12, conductive layer 13, interlayer insulation layers 15*a*, 15*b*, heat generating resistor member 16, common electrode 17*a*, individual electrodes 17*b*, 17*c* and protection layer 18 formed thereon are formed on the thermal radiating substrate 11 having an area of several times of area of each of the thermal heads, thereafter, the thermal head substrates are cut to manufacture an individual thermal head.

The method of cutting the thermal head substance 20 is explained with reference to FIG. 6 and FIG. 7.

In the method of manufacturing a thermal head in this embodiment, a laser beam is utilized for the step of cutting a thermal head substance 20 having a plurality of thermal heads 21. As the laser beam, an excimer laser beam is used particularly.

The excimer laser emits UV-rays depending on gas species used for the laser oscillation, for example, at 308 nm for XeCl gas, 248 nm for KrF gas and 193 nm for ArF gas. In laser fabrication, although $Co_2$ laser and YAG laser are generally used, they are fabrication by spot heating at high temperature and are not suitable to fine fabrication since they leave thermal damages on works or deposit scattered matter on the work upon heat melting. On the other hand, since the excimer laser is a UV-ray laser, which decomposes, scatters and eliminates a work instantaneously, it gives less thermal effect and provides high fabrication quality.

In the method of manufacturing the thermal head in this embodiment, the characteristics of the excimer laser are applied in which a groove is formed to a portion to be cut by an excimer laser beam and the bottom of the groove is cut by dicing in the cutting step for the thermal head 20.

Figure 6A:
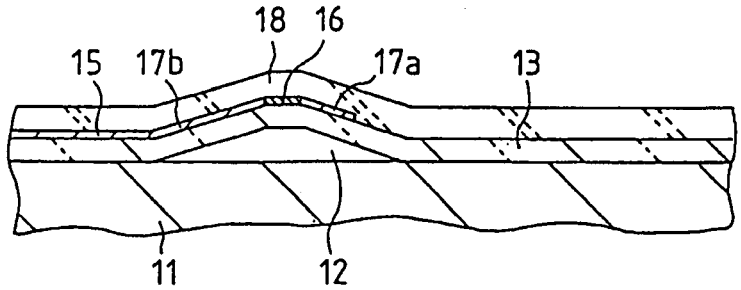
FIG. 6A is a cross sectional view illustrating a substrate of a thermal head just before entering a cutting step.

FIG. 6A is an explanatory view illustrating a cutting step for a thermal head unit 20.

Figure 6B:
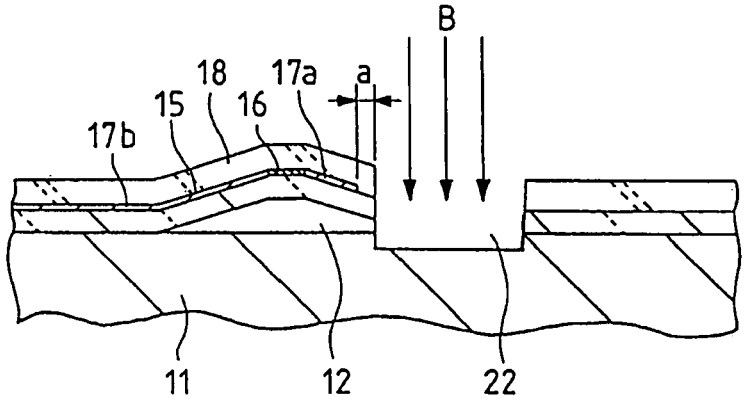
FIG. 6B is a cross sectional view illustrating a state of forming a groove by irradiation of a laser beam.

FIG. 6A shows a substrate 11 for the thermal head after completion of the formation of the protecting layer 18 and just before entering the cutting step. As shown in FIG. 6B, after properly aligning a size a from the end of the common electrode 17*a*, KrF excimer laser beam B is irradiated to form a groove 22. The groove 22 has a depth reaching as far as the substrate 11. An output of the laser is suitably from 10 to 50 W.

Figure 6C:
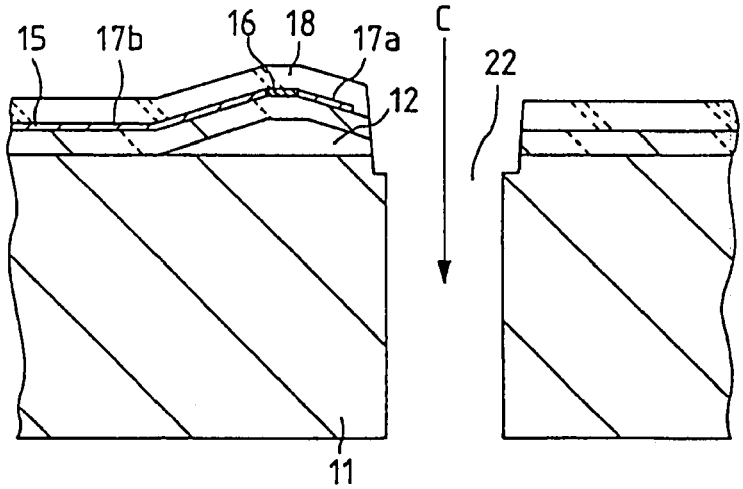
FIG. 6C is a cross sectional view illustrating a state of cutting from the bottom of a groove to a rear face of a substrate by a dicing method.

Then, as shown in FIG. 6C, the bottom of the groove 22 is cut as far as the rear face of the substrate 11 in the direction of C by a dicing method.

According to this method, since mechanical stresses or thermal stresses applied to the laminate portion of the thermal head upon cutting can be extremely decreased, troubles such as chipping at the film lamination part as well as its clack can be eliminated. That is, while at least 20 μm is required for the size a from the end of the common electrode 17*a* to the cutting face, the size can be reduced to several micrometers in the method according to this embodiment. Further, it takes only from one to several minutes for forming the groove by the laser beam and the fabrication time can be shortened by ⅕ to 1/10 as compared with that for polishing and low cost fabrication can be attained.

Figure 7A:
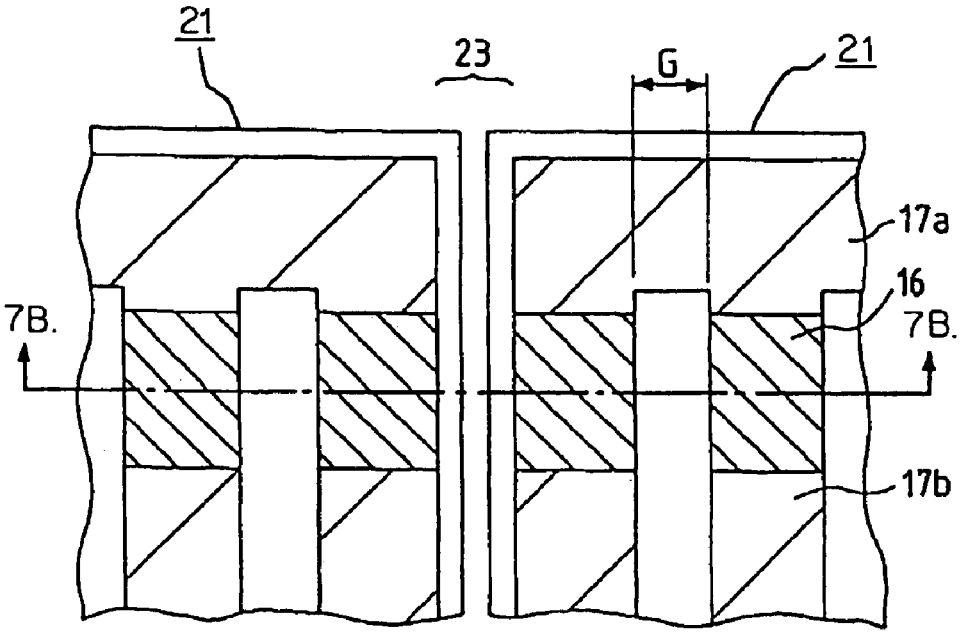
FIG. 7A is a plan view of a heat generating portion of thermal heads connected in a main scanning direction.

Further, FIG. 7A is a plan view for a heat generating portion when thermal heads cut by the cutting method as described above are connected along a main scanning direction to prepare an elongate thermal head. FIG. 6B is a cross sectional view taken along line 7B-7B FIG. 7A.

The dot gap G shown in the plan view of FIG. 6A is decreased as the density of the heat generating body is increased and it is about 20 μm at present. Therefore, the distance between the ends of the heat generating resistor members 16 of both of the thermal heads 21 has to be finished to about 20 μm also at a connection portion 23. That is, it is necessary to cut the substrate within 10 μm from the end of the heat generating resistor member 16 and the method according to the present invention is effective if a cost is also taken into consideration.

Figure 7B:
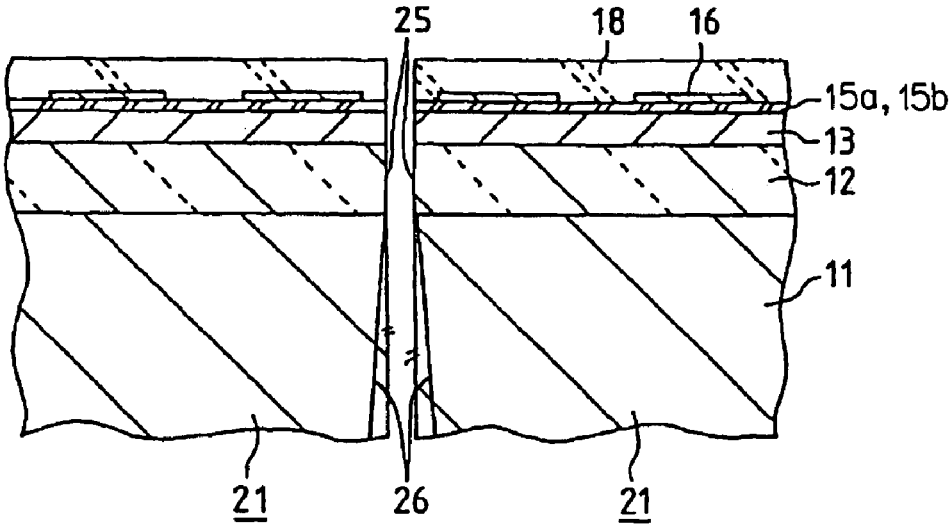
FIG. 7B is a cross sectional view taken along a line 7B-7B in FIG. 7A.
Figure 8:
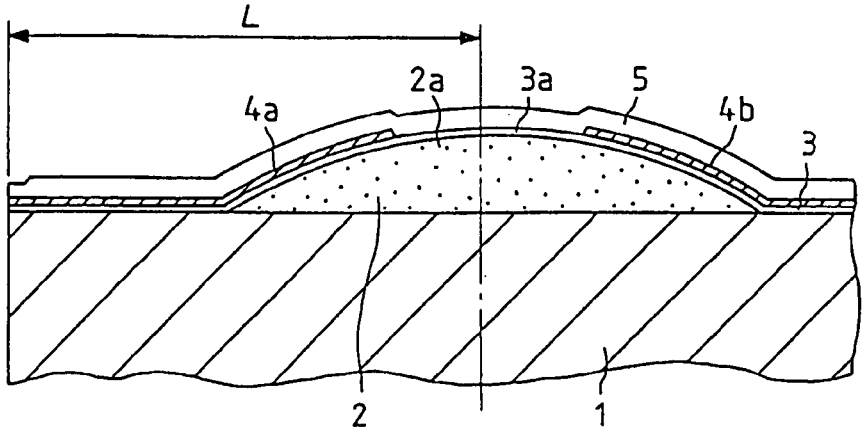
Fig. 8 PRIOR ART
FIG. 8 is a cross sectional view illustrating a constitution of a general thermal head of the prior art.
Figure 9:
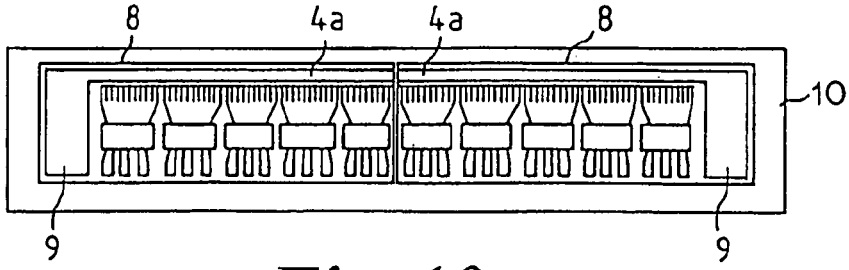
Fig. 9 PRIOR ART
FIG. 9 is a plan view illustrating a constitution of a connection type thermal head of the prior art.
Figure 10:
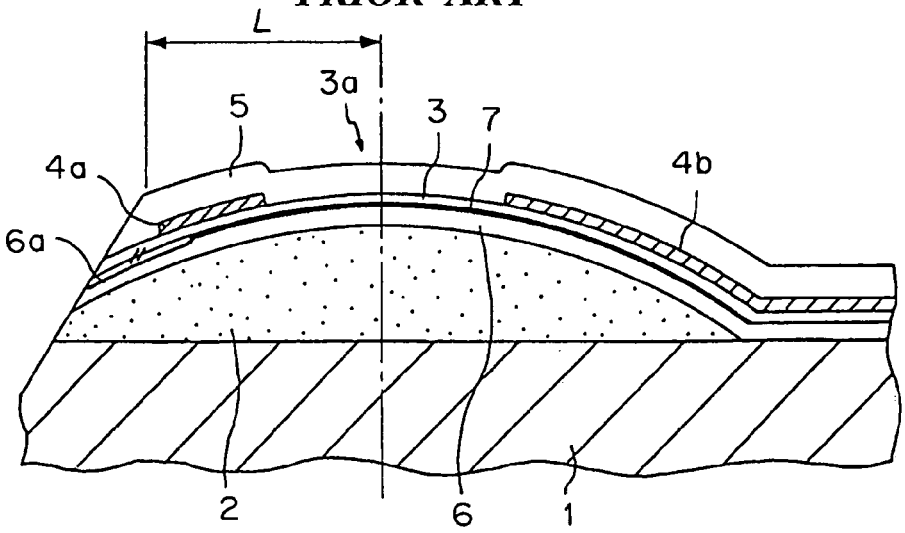
Fig. 10 PRIOR ART
FIG. 10 is a sectional view for showing a configuration of the thermal head of the prior art multilayered wiring structure.

Then, in this embodiment, as can be seen from the cross sectional view of FIG. 7*b*, only the portion for the substrate 11 is polished such that the laser cut face 25 of the laminate and the end face 26 of the substrate 11 are substantially in flush with each other. In this case, in which the substrate 11 comprising a single kind of material is polished, it can be processed at a high accuracy in a short period of time. Further, connection accuracy for the connectable thermal head block 21 can be improved by obliquely polishing the portion for the substrate 11 thereby making the laser cut face of the laminate into a most protruded shape.

As has been described above according to the present invention, since the conductive layer is made of a nitride and a metal or a fused material of an oxide and a metal having thermet material comprising a fused material of a lesser heat conductivity and thermal expandability, it has excellent close bondability with the substrate even if subjected to thermal oxidation at a high temperature.

Further, since the conductive layer having the same function as the common electrode of the thermal head is disposed over the entire surface of the substrate, a uniform voltage can be applied to each of the heat generating resistor members to reliably prevent degradation of thermal characteristics, uneven printing density or troubles caused by lack of current capacity or current leakage, so that it can properly correspond to real edging of a thermal head. Further, if the interlayer insulation layer is formed as a composite layer, reliability of the insulation property can be improved further.

Further, in the step of manufacturing the multilayered substrate, since the nitrate (for example, aluminum nitride) and the oxide (for example, aluminum oxide) constituting the conductive layer are less etched by the etchant such as buffered hydrofluoric acid or $CF_4$+$0_2$ gas, the conductive layer and the first interlayer insulation layer suffer from no damages and an oxidation resistant mask and a resistor member pattern can be formed at a high accuracy, to thereby improve the production yield.

Further, since the first interlayer insulation layer integrated with the conductive layer is formed by thermal oxidation with the heat resistant mask with formed on the surface of the conductive layer, the step between the exposed portion of the conductive layer and the first interlayer insulation layer can be minimized to ensure the insulation property, close bondability and electric conductivity with the heat generating resistor member. Further, high temperature annealing upon oxidation step for forming the first interlayer insulation layer can improve mechanical and thermal reliability of the multilayered wiring substrate.

Further, in the real edge thermal head using the multilayered wiring substrate according to the present invention, an external connecting terminal (a common electrode terminal) of the common electrode can be formed at least to three portions in the substrate to reliably prevent uneven printing density, troubles caused, for example, by lack of current capacity. Further, it is possible to reduce the size of the line thermal head substrate and reduce the production cost. Further, since the common electrode for the edge portion can be formed thinly with a hard material even when it is real edged extremely, the printing life can be increased in cooperation with the effect of the protecting layer. Further, the real edge structure enables the use of the resin ink ribbon and appropriate use of the ink ribbon can remarkably improve the printing quality on rough paper. Further, loss of contact pressure of the heat generating resistor member to the platen can be reduced remarkably, the effect of collapsing unevenness in the tissue of paper fibers can be improved remarkably, the printing quality particularly on rough paper can be improved and electric power can be saved.

Further, by the method of cutting the substrate of the thermal head unit by the application of laser fabrication, real edging of individual thermal head blocks can be attained to enable high quality printing on rough paper or common paper. Furthermore, according to the cutting method for the substrate, since accurate cutting causing no chipping or cracking at the cut face is possible, highly a large density of heat generating body can be manufactured, as well as since the time required for cutting is short, it can also provide an advantageous effect capable of reducing the production cost.

We claim:

1. A thermal head comprising:

a thermal radiating substrate;

a temperature keeping layer formed on the thermal radiating substrate;

a conductive layer formed on the thermal radiating substrate and an upper surface of the temperature keeping layer comprised of a fused material of nitride and metal or a fused material of oxide and metal;

a first interlayer insulation layer formed by oxidization of the conductive layer except a portion of the conductive layer corresponding to a common electrode and a portion of the common electrode corresponding to an external connecting common electrode terminal;

a second interlayer insulation layer comprised of insulating ceramics formed on the upper surface of the first interlayer insulation layer;

a heat generating resistor member formed above the second interlayer insulation layer and the conductive layer;

a common electrode and individual electrodes formed at a part of the upper surface of the heat generating resistor member; and a protecting layer covering the heat generating resistor member, common electrode, individual electrodes and second interlayer insulation layer.

2. A thermal head according to claim 1, wherein the second interlayer insulation layer is formed by insulating ceramics comprised of at least one of silicon nitride, silicon oxide, aluminum nitride or aluminum oxide.

3. A thermal head according to claim 1, wherein at least more than three common electrode terminals of the common electrode for the external connection are formed in the thermal radiating substrate.

4. A thermal head according to claim 1, wherein cutting planes of the temperature keeping layer, conductive layer, first interlayer insulation layer, second interlayer insulation layer and protecting layer at the cutting plane of the thermal head cut in a direction perpendicular to arranging directions of a plurality of the heat generating resistor members are formed substantially in perpendicular to a plane of the thermal radiating substrate and the cutting plane at the thermal radiating substrate is substantially in flush with the cutting plane at the film layer portion.

5. A thermal head according to claim 1, wherein cutting planes of the temperature keeping layer, conductive layer, first interlayer insulation layer, second interlayer insulation layer and protecting layer at the cutting plane of the thermal head cut in a direction perpendicular to arranging directions of a plurality of the heat generating resistor members are formed substantially in perpendicular to a plane of the thermal radiating substrate and the cutting plane at the thermal radiating substrate forms a slant plane entered into the thermal radiating substrate.

6. A thermal head comprising:

a temperature keeping layer formed on the thermal radiating substrate;

a conductive layer formed on the thermal radiating substrate, wherein one of silicon nitride, silicon oxide, aluminum nitride or aluminum oxide or these complex materials being applied as insulation material, and the conductive layer being formed by conductive thermet comprised of fused material of this insulation material and metal of high melting point;

a first interlayer insulation layer formed by oxidization of the surface of the conductive layer except a portion of the conductive layer corresponding to a common electrode and a portion of the common electrode corresponding to an external connecting common electrode terminal;

a second interlayer insulation layer comprised of insulating ceramics formed on the upper surface of the first interlayer insulation layer;

a heat generating resistor member formed above the second interlayer insulation layer and the conductive layer;

a common electrode and individual electrodes formed at a part of the upper surface of the heat generating resistor member; and a protecting layer covering the heat generating resistor member, common electrode, individual electrodes and second interlayer insulation layer.

7. A thermal head according to claim 6, wherein the metal of high melting point is tantalum.

8. A thermal head comprising:

a thermal radiating substrate;

a temperature keeping layer formed on the thermal radiating substrate;

a conductive layer formed on the thermal radiating substrate, wherein the conductive layer being formed of conductive ceramics comprised of boride, nitride, carbide or silicide of high melting point metal;

a first interlayer insulation layer formed by oxidization of the surface of the conductive layer except a portion of the conductive layer corresponding to a common electrode and a portion of the common electrode corresponding to an external connecting common electrode terminal;

a second interlayer insulation layer comprised of insulating ceramics formed on the upper surface of the first interlayer insulation layer;

a heat generating resistor member formed above the second interlayer insulation layer and the conductive layer;

a common electrode and individual electrodes formed at a part of the upper surface of the heat generating resistor member; and a protecting layer covering the heat generating resistor member, common electrode, individual electrodes and second interlayer insulation layer.

* * * * *